US007356288B2

(12) United States Patent
Iwata et al.

(10) Patent No.: US 7,356,288 B2
(45) Date of Patent: Apr. 8, 2008

(54) DEVELOPING APPARATUS HAVING IMPROVED AGITATION EFFECT

(75) Inventors: Nobuo Iwata, Sagamihara (JP); Satoshi Muramatsu, Tokyo (JP); Nobutaka Takeuchi, Yokohama (JP); Junichi Matsumoto, Yokohama (JP); Takayuki Koike, Sendai (JP)

(73) Assignee: Ricoh Co., Ltd., Tokyo (JP)

( * ) Notice: Subject to any disclaimer, the term of this patent is extended or adjusted under 35 U.S.C. 154(b) by 177 days.

(21) Appl. No.: 11/298,888

(22) Filed: Dec. 12, 2005

(65) Prior Publication Data

US 2006/0140679 A1 Jun. 29, 2006

(30) Foreign Application Priority Data

Dec. 10, 2004 (JP) ..... 2004-358599

(51) Int. Cl.
*G03G 15/08* (2006.01)

(52) U.S. Cl. ..... 399/254; 399/256; 399/257

(58) Field of Classification Search ..... 399/254, 399/256, 257, 258, 259, 263; 366/279, 292, 366/293, 318, 319; 222/DIG. 1
See application file for complete search history.

(56) References Cited

U.S. PATENT DOCUMENTS 4,887,132 A * 12/1989 Joseph et al. ..... 399/256
5,250,749 A * 10/1993 Aimoto ..... 399/257
5,430,532 A * 7/1995 Ueda et al. ..... 399/263
5,682,584 A * 10/1997 Hattori et al. ..... 399/256 X
6,122,472 A * 9/2000 Sako et al. ..... 366/254
6,125,243 A * 9/2000 Shoji et al. ..... 399/257 X
2004/0057755 A1* 3/2004 Yamaguchi et al. ..... 399/256
2004/0265009 A1* 12/2004 Shigeta at al. ..... 399/254

FOREIGN PATENT DOCUMENTS

JP 05-289517 11/1993
JP 06-186856 A * 7/1994
JP 07-134481 5/1995
JP 2000-047474 2/2000
JP 2000-122423 4/2000
JP 2003-263012 9/2003
JP 2004-054096 A * 2/2004
JP 2004-191882 7/2004
JP 2004-205535 7/2004
JP 2004-258237 9/2004
JP 2004-279979 A * 10/2004
JP 2005-017872 1/2005
JP 2005-024799 1/2005
JP 2005-128043 5/2005
JP 2005-189283 7/2005
JP 2005-202317 7/2005

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A developing apparatus for use in an image forming apparatus includes a developing roller, a developing agent, a refilling port, a transport member, and an agitation enhancer. The developing agent includes toner particles and carrier particles and is refilled to the developing apparatus from the refilling port. The transport member transports the developing agent to the developing roller while agitating the developing agent. The agitation enhancer is provided on a peripheral portion of the transport member to increase agitation movement of the developing agent.

24 Claims, 7 Drawing Sheets

DEVELOPING APPARATUS HAVING IMPROVED AGITATION EFFECT

TECHNICAL FIELD

The present disclosure generally relates to a developing apparatus for use in an image forming apparatus, and more specifically, to a developing apparatus for improving the agitation effectiveness of developing agents.

BACKGROUND

A two-component developing agent for use in a developing apparatus generally includes non-magnetic toner particles and magnetic carrier particles. In the developing apparatus, the toner particles and carrier particles are mixed, and the mixed particles are used as developing agent.

Such developing agent is applied to an electrostatic latent image formed on a surface of a photosensitive member to develop the electrostatic latent image as toner image.

Because the toner particles are consumed as the number of image forming times increases, a developing apparatus is supplied with fresh toner particles from a toner container via a toner refilling port of the developing apparatus. Such toner container maybe connected to the developing apparatus.

On one hand, the carrier particles are not consumed as the number of image forming times increases. However, the carrier particles need to be replaced with fresh carrier particles at a predetermined time because the carrier particles may degrade over the time.

Such replacement can be conducted by a service person by replacing used carrier particles with fresh carrier particles, or by replacing a cartridge-type developing apparatus including carrier particles therein, for example.

In one method, the carrier particles can be refilled in a developing apparatus by supplying fresh carrier particles from a refilling container to the developing apparatus, as required.

In another method, a refilling developing agent prepared by mixing carrier particles with toner particles in advance can be supplied to the developing apparatus, as, required.

In another method, excessive carrier particles can be ejected from a developing apparatus, as required, to prevent degradation of developing-agent.

In general, fresh toner particles or fresh carrier particles for refilling are supplied in the developing apparatus and are fed to a transport screw provided in the developing apparatus.

Then the fresh toner particles or fresh carrier particles are agitated with the developing agent existing in the developing apparatus by the transport screw, and transported to a developing roller.

If the developing agent is not effectively mixed with the fresh toner particles or fresh carrier particles in the developing apparatus, toner particles may not be effectively charged or may be charged with unfavorable polarity at the developing roller.

Such toner particles may scatter on a surface of a photosensitive member or in an image forming apparatus, which result into a degradation of image quality.

In view of such background, methods of refilling the developing agent to the developing apparatus have been studied. For example, a mixing effectiveness of developing agent can be improved by enhancing agitation effectiveness of particles.

In one method, agitation effectiveness is improved by providing an agitator for mixing fresh refilling particles and the developing agent and supplying such mixed particles to the developing apparatus. In another method, agitation effectiveness is improved by adjusting the height of the transport member such as screw with respect to a height level of developing agent in the developing apparatus.

In general, a transport screw mainly transports the developing agent in a shaft direction of the transport screw. Accordingly, the transport screw may not effectively mix fresh toner particles or carrier particles with the developing agent existing in the developing apparatus.

In case of refilling only the carrier particles, types of refilling particles can be reduced in number because the carrier particles can be commonly used for different color toners used for a color image forming apparatus. However, in such a case, effective agitation is required to mix the refilled carrier particles and the developing agent existing in the developing apparatus.

If the refilled carrier particles and the developing agent are not effectively mixed in the developing roller, toner particles may not be effectively charged or may be charged with unfavorable polarity at the developing roller.

Such toner particles may scatter on the surface of a photosensitive member or in an image forming apparatus, which result into a degradation of image quality.

However, excessive agitation may induce excessive energy to the developing agent. Such excessive energy may cause physical stress such as abrasion and break-up to the toner particles or carrier particles, and thus may degrade the developing agent.

SUMMARY OF THE INVENTION

The present disclosure relates to a developing apparatus for use in an image forming apparatus. The developing apparatus includes a developing roller, a developing agent, a refilling port, a transport member, and an agitation enhancer. The developing agent includes toner particles and carrier particles and is refilled to the developing apparatus from the refilling port. The transport member transports the developing agent to the developing roller while agitating the developing agent. The agitation enhancer is provided on a periphery of the transport member to increase an agitation movement of the developing agent The present disclosure relates to a process cartridge for use in an image forming apparatus. The process cartridge includes a photosensitive member and a developing apparatus. The photosensitive member forms an electrostatic latent image. The developing apparatus develops the electrostatic latent image, and includes a developing roller, a developing agent, a refilling port, a transport member, and an agitation enhancer. The developing agent includes toner particles and carrier particles and is refilled in the developing apparatus from the refilling port. The transport member transports the developing agent to the developing roller while agitating the developing agent. The agitation enhancer is provided on a periphery of the transport member to increase an agitation movement of the developing agent.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF THE PREFERRED EMBODIMENTS

Figure 1:
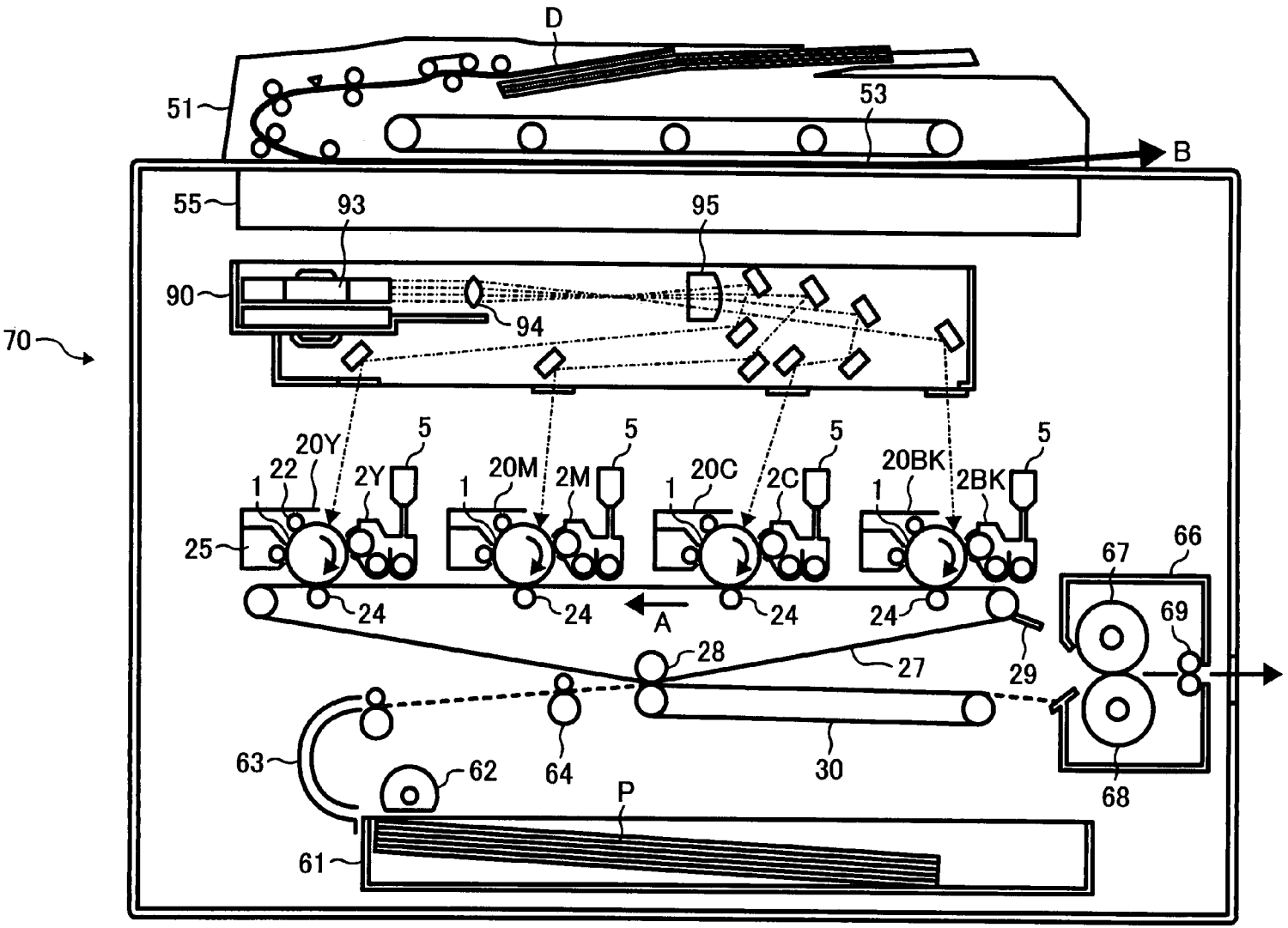
FIG. 1 is a schematic sectional view of an image forming apparatus according to an example embodiment.

In describing the exemplary embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, a developing apparatus for use in an image forming apparatus is described with reference to FIGS. 1 to 6.

Hereinafter, an image forming apparatus 70 according to an exemplary first embodiment is explained with reference to FIG. 1. The image forming apparatus 70 can be used for color image forming, for example.

As shown in FIG. 1, the image forming apparatus 70 includes an optical writing unit 90, process cartridges 20Y, 20M, 20C, and 20BK, a photosensitive member 1, a charge unit 22, developing apparatuses 2Y, 2M, 2C, and 2BK, a first transfer bias roller 24, a cleaning unit 25, an intermediate transfer belt 27, a second transfer bias roller 28, an transfer belt cleaning unit 29, a transport belt 30, a toner container 5, a document feed unit 51, a scanner 55, a sheet feed unit 61 for storing a recording medium P, and a fixing unit 66.

The optical writing unit 90 emits a laser beam L corresponding to an image information input into the image forming apparatus 70. The photosensitive member 1 is included in each of the process cartridges 20Y, 20M, 20C, and 20BK as image carrying member. The charge unit 22 charges a surface of the photosensitive member 1.

Each of the developing apparatuses 2Y, 2M, 2C, and 2BK develops an electrostatic latent image formed on the photosensitive member 1 as toner image.

The first transfer bias roller 24 transfers the toner image from the photosensitive member 1 to the intermediate transfer belt 27, on which a plurality of different toner images is super-imposingly transferred.

The cleaning unit 25 recovers toner remaining on the photosensitive member 1 after transferring the toner image from the photosensitive member 1 to the intermediate transfer belt 27.

The second transfer bias roller 28 transfers the toner image on the intermediate transfer belt 27 to the recording medium P.

The transfer belt cleaning unit 29 recovers toner remaining on the intermediate transfer belt 27 after transferring the toner image from the intermediate transfer belt 27 to the recording medium P.

The transport belt 30 transports the recording medium P having the toner image thereon.

The toner container 5 supplies respective color toners T to the respective developing apparatuses 2Y, 2M, 2C, and 2BK.

The document feed unit 51 transports a document D to the scanner 55. The scanner 55 scans image information of the document D.

The sheet feed unit 61 stores the recording medium P such as transfer sheet, for example.

The fixing unit 66 fixes the toner image on the recording medium P.

The above-mentioned process cartridges 20Y, 20M, 20C, and 20BK includes the photosensitive member 1 and the respective developing apparatuses 2Y, 2M, 2C, and 2BK as integrated components.

The above-mentioned process cartridges 20Y, 20M, 20C, and 20BK can further include the charge unit 22, and the cleaning unit 25 as integrated components. If the process cartridges 20Y, 20M, 20C, and 20BK includes the charge unit 22, and the cleaning unit 25 as integrated components, it is preferable to improve maintenance-ability of the image forming apparatus 70.

An image forming for each color of yellow, magenta, cyan, and black is conducted on the photosensitive member 1 included in each of the process cartridges 20Y, 20M, 20C, and 20BK.

Hereinafter, a color image forming to be conducted in the image forming apparatus 70 is explained.

At first, the document feed unit 51 transports the document D on a document tray in a direction shown by an arrow B in FIG. 1 by a transport roller, and is placed on a contact glass 53 of the scanner 55. The scanner 55 optically scans image information of the document D.

For example, the scanner 55 scans the image of the document D placed on the contact glass 53 by irradiating light emitted from a light source (not shown). The light reflected on the document D is focused on a color sensor via mirrors and lenses.

The color image information of the document D is read by the color sensor for each color of red, green, and blue (RGB), and converted into electrical signals for each of RGB. An image processing unit (not shown) conducts processing such as color conversion, color correction, and space frequency correction to the electrical signals for each of RGB to generate image data for yellow, magenta, cyan, and black.

The image data for yellow, magenta, cyan, and black is then transmitted to the optical writing unit 90. The optical writing unit 90 emits a laser beam corresponding to the respective color image data to the photosensitive member 1 included in each of process cartridges 20Y, 20M, 20C, and 20BK.

As shown in FIG. 1, the photosensitive member 1 rotates in a clockwise direction, for example. The charge unit 22 uniformly charges the surface of the photosensitive member 1.

Then the charged surface of the photosensitive member 1 comes to a position so as to be irradiated by a laser beam emitted from the optical writing unit 90.

As above-mentioned, the optical writing unit 90 emits a laser beam L corresponding to the respective image data for yellow, magenta, cyan, and black, The generated laser beam reflected from a polygon mirror 93, passes through lenses 94 and 95.

After passing through the lenses 94 and 95, the laser beam is split into a plurality of laser beams for each of yellow, magenta, cyan, and black image, and such split laser beam is led to respective light path for each of yellow, magenta, cyan, and black image.

A laser beam for a yellow image is reflected at mirrors, and then irradiated on the surface of the photosensitive member 1 in the process cartridge 20Y.

The laser beam for the yellow image is scanned to a main scanning direction of the photosensitive member 1 by rotating the polygon mirror 93 in a high speed.

Then, the charge unit 22 charges the surface of the photosensitive member 1 to form an electrostatic latent image for yellow image on the photosensitive member 1.

In a similar manner, a laser beam for a magenta image is reflected at mirrors, and then irradiated on the surface of the photosensitive member 1 in the process cartridge 20M to form an electrostatic latent image for magenta image on the photosensitive member 1.

In a similar manner, a laser beam for a cyan image is reflected at mirrors, and then irradiated on the surface of the photosensitive member 1 in the process cartridge 20C to form an electrostatic latent image for cyan image on the photosensitive member 1.

In a similar manner, a laser beam for a black image is reflected at a mirror, and then irradiated on the surface of the photosensitive member 1 in the process cartridge 20BK to form an electrostatic latent image fox black image on the photosensitive member 1.

Then, the surface of the photosensitive member 1 in the process cartridges 20Y, 20M, 20C, and 20BK comes to be positioned facing the respective developing apparatuses 2Y, 2M, 2C, and 2BK.

Each of the developing apparatuses 2Y, 2M, 2C, and 2BK supplies respective color toner to the respective surface of the photosensitive member 1 in the process cartridges 20Y, 20M, 20C, and 20BK to develop the electrostatic latent image on the photosensitive member 1 as toner image.

After such developing process, the surface of the photosensitive member 1 in the respective process cartridges 20Y, 20M, 20C, and 20BK comes to a position facing the intermediate transfer belt 27.

As shown in FIG. 1, the first transfer bias roller 24, provided on an inner surface of the intermediate transfer belt 27, faces such position via the intermediate transfer belt 27.

The first transfer bias roller 24 transfers the color toner images formed on the photosensitive member I in the respective process cartridges 20Y, 20M, 20G, and 20BK to the intermediate transfer belt 27 by superimposing the color toner images on the intermediate transfer belt 27. After transferring the color toner images to the intermediate transfer belt 27, the surface of the photosensitive member I comes to a position facing the cleaning unit 25. The cleaning unit 25 recovers toners remained on the photosensitive member 1.

Then, a de-charging unit (not shown) de-charges the surface of the photosensitive member 1.

A series of image forming process for the photosensitive member 1 is completed as such.

The intermediate transfer belt 27 having the color toner images thereon travels in a direction shown by an arrow A and comes to a position at the second transfer bias roller 28.

Then, the color toner images are transferred from the intermediate transfer belt 27 to the recording medium P at the position of the second transfer bias roller 28.

After transferring the color toner images, the intermediate transfer belt 27 comes to a position facing the transfer belt cleaning unit 29. The transfer belt cleaning unit 29 recovers toners remained on the intermediate transfer belt 27.

A series of transfer process for the intermediate transfer belt 27 is completed as such.

The recording medium P fed to the position of the second transfer bias roller 28 is transported from the sheet feed unit 61 through a transport guide 63, and pair of registration rollers 64.

For example, the recording medium P stored in the sheet feed unit 61 is fed to the transport guide 63 by a feed roller 62, and further guided to the pair of registration rollers 64 through the transport guide 63.

After the recording medium P reaches the pair of registration rollers 64, the recording medium P is fed to the position of the second transfer bias roller 28 by adjusting a feed timing with toner image formation on the intermediate transfer belt 27.

Then, the recording medium P is transported to the fixing unit 66 by the transport belt 30.

The fixing unit 66 includes a heat roller 67 and a pressure roller 68, which form a nip therebetween. The color toner images are fixed on the recording medium P at the nip, After such fixing process, the recording medium P is ejected to a location outside the image forming apparatus 70 by the sheet ejection roller 69.

In the above-described manner, a series of image forming process in the image forming apparatus 70 is completed.

Hereinafter, the developing apparatuses 2Y, 2M, 2C, and 2BK is explained with reference to FIG. 2 to FIG. 6.

Because the developing apparatuses 2Y, 2M, 2C, and 2BK have similar configurations to one another, the developing apparatuses 2Y, 2M, 2C, and 2BK are referred as the developing apparatus 2. Similarly, the process cartridges 20Y, 20M, 20C, and 20BK are referred as the process cartridge 20.

Figure 2:
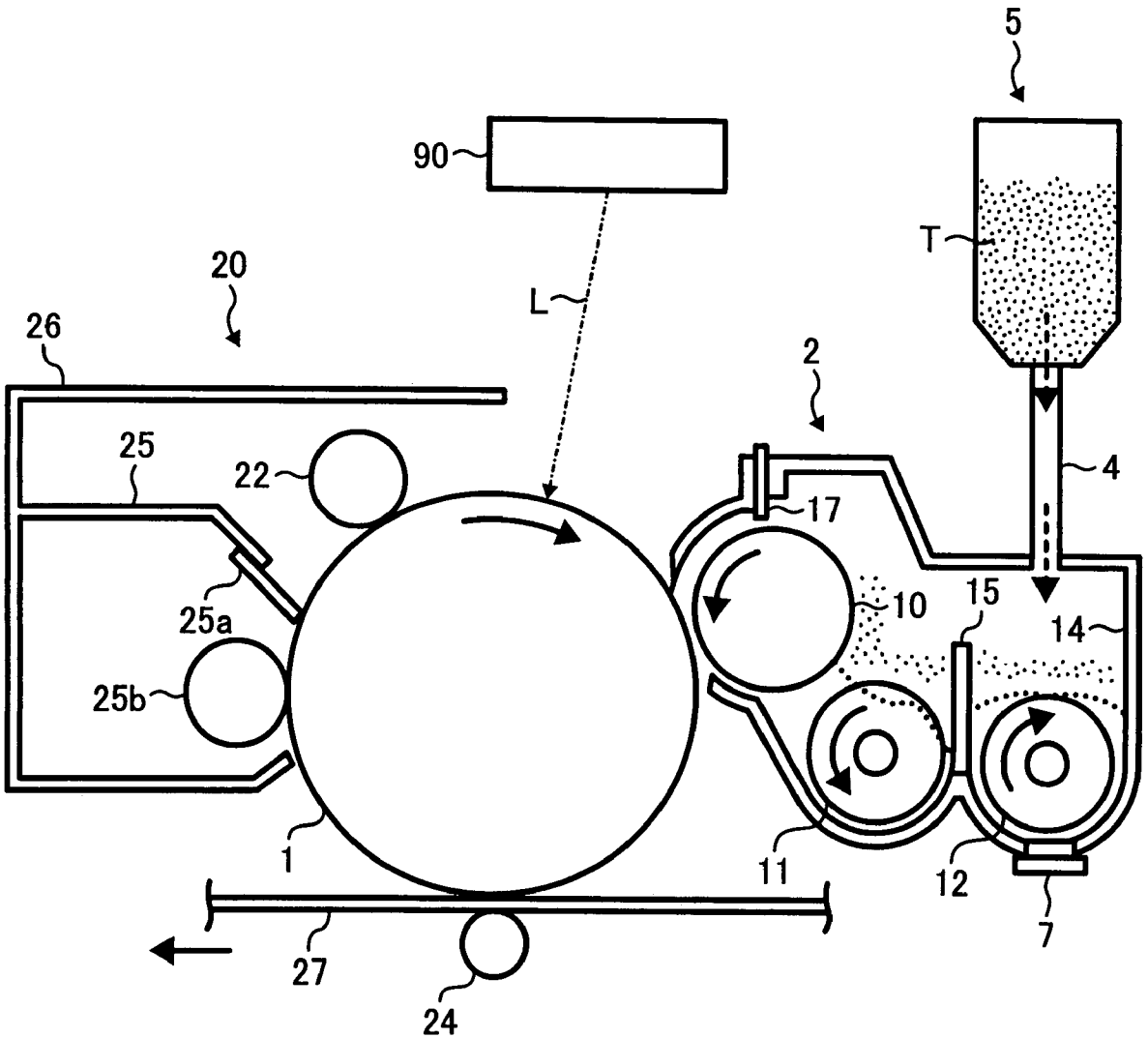
FIG. 2 is a schematic sectional view of a process cartridge for use in an image forming apparatus of FIG. 1.

As shown in FIG. 2, the process cartridge 20 includes the photosensitive member 1 and the developing apparatus 2.

The process cartridge 20 can further include the charge unit 22 and the cleaning unit 25. If the process cartridge 20 includes the charge unit 22 and the cleaning unit 25, it is preferable from a viewpoint of maintenance-ability.

The process cartridge 20 including the above-mentioned components can be integrally supported by a frame such as casing 26, for example. The frame such as casing 26 can be made of materials such as resin, for example.

As shown in FIG. 2, the cleaning unit 25 includes a cleaning blade 25*a* and a cleaning roller 25*b*, which can contact the photosensitive member 1.

Figure 3:
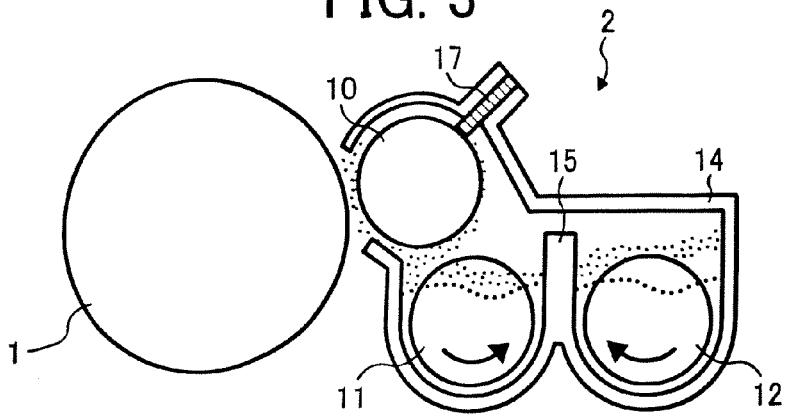
FIG. 3 is a crass-sectional view of a developing apparatus according to an example embodiment.

As shown in FIGS. 2 and 3, the developing apparatus 2 includes a developing roller 10, a first transport screw 11, a second transport screw 12, a casing 14, a partition 15, and a doctor blade 17.

The developing roller 10 faces the photosensitive member 1. The first transport screw 11 is provided in proximity of the developing roller 10. The second transport screw 12 is provided in a parallel manner with respect to the first transport screw 11, wherein the partition 15 is provided between the first transport screw 11 and the second transport screw 12. The doctor blade 17 can contact the developing roller 10.

FIG. 3 is a cross-sectional view of the developing apparatus 2. As shown in FIG. 3, the casing 14 contains the first transport screw 11 and the second transport screw 12, which can rotate in directions shown by the arrows.

The first transport screw 11 includes a spiral shaped fin member and the second transport screw 12 also includes a spiral shaped fin member.

The partition 15 separates the casing 14 into a first and second compartment for accommodating the first transport screw 11 and the second transport screw 12, respectively.

In the developing apparatus 2, refilled toner particles are agitated with the developing agent existing in the developing apparatus 2, and recirculated along the first transport screw 11 and the second transport screw 12.

A part of the recirculating developing agent is attracted onto the developing roller 10 by magnetic power, and leveled-off in a uniform thickness on the developing roller 10 by the doctor blade 17.

Then the charged toner particles are supplied on an electrostatic latent image formed on the surface of the photosensitive member 1 to develop the electrostatic latent image as toner image.

Figure 4:
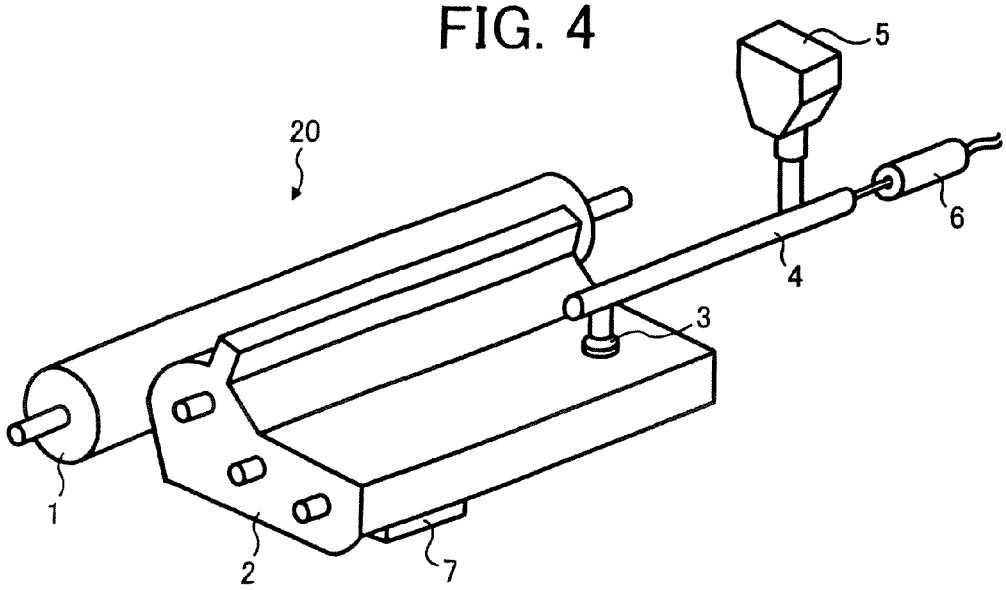
FIG. 4 is a schematic perspective view of a developing apparatus for refilling toner particles according to an example embodiment.

FIG. 4 is a schematic perspective view of the developing apparatus 2 and the photosensitive member 1. As shown in FIG. 4, the developing apparatus 2 is provided with a refilling port 3, a toner supply route 4, a toner container 5, a motor 6, and a toner concentration sensor 7.

As above-mentioned, the developing apparatus 2 and the photosensitive member 1 can be integrated as the process cartridge 20.

As above-mentioned, an electrostatic latent image formed on the photosensitive member 1 is developed by the developing apparatus 2, wherein the developing apparatus 2 supplies toner particles to the electrostatic latent image formed on the surface of the photosensitive member 1 to develop the electrostatic latent image as toner image.

Toner particles in the developing apparatus 2 are consumed as the number of image forming times increases, thereby toner particles are refilled in the developing apparatus 2 via the refilling port 3.

Toner particles stored in the toner container 5 are transported in the toner supply route 4 using a screw (not shown) provided in the toner supply route 4, and refilled in the developing apparatus 2 via the refilling port 3, as required. The motor 6 drives the screw (not shown) in the toner supply route 4.

The toner concentration sensor 7 detects a mix ratio of toner particles and carrier particles in the developing apparatus 2. Based on the mix ratio information detected by the toner concentration sensor 7, a controller (not shown) controls refilling condition of toner particles.

Figure 5:
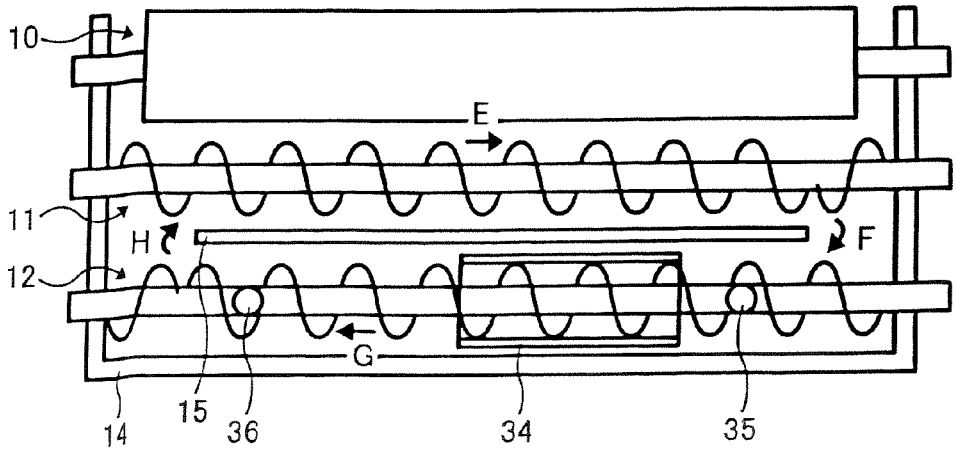
FIG. 5 is a plan view of a developing apparatus of FIG. 4.

FIG. 5 is a plan view of the developing apparatus 2. As shown in FIG. 5, the developing roller 10, the first transport screw 11, and the second transport screw 12 are disposed in a parallel manner with each other.

As shown in FIG. 5, particles can be circulated from the first to second compartment or from the second to first compartment because a partition-free space is provided on both end of the partition 15.

The refilling port 3 shown in FIG. 4 is connected to a port 35 shown in FIG. 5 to refill the toner particles in the developing apparatus 2.

The toner concentration sensor 7 shown in FIG. 4 detects a toner concentration at a point 36 shown in FIG, 5.

With rotation of the first transport screw 11 and second transport screw 12, the developing agent is transported and recirculated in a direction shown by arrows E, F, G, and H (i.e., E->F->G->H), for example.

Different from a conventional transport screw, which mainly transports the developing agent in a shaft direction of the transport screw, the second transport screw 12 is provided with a tubular member 34 to improve agitation effectiveness in a radius direction of the second transport screw 12.

As shown in FIG. 5, the tubular member 34 is provided on a part of the second transport screw 12.

As shown in FIG. 5, the tubular member 34 is provided at a position downstream of the refilling port 3. Furthermore, the tubular member 34 is provided at a position between the refilling port and the toner concentration sensor 7.

The developing agent passing through the tubular member 34 can be transported in the shaft direction of the second transport screw 12 while receiving an agitation movement in a radius direction of the tubular member 34. Such agitation in a radius direction of the tubular member 34 may be caused by a vortex generated in the tubular member 34.

By providing the tubular member 34 on a part of the second transport screw 12, the developing agent can be effectively agitated without receiving excessive physical stress. If the second transport screw 12 is surrounded by the tubular member 34 entirely, the developing agent may receive an excessive physical stress.

With such configuration shown FIG. 5, the developing agent can be effectively agitated without receiving excessive physical stress in the developing apparatus 2.

FIGS. 6A, 6B, 6C, and 6D show transport screws, which are made by modifying a conventional transport screw to improve agitation effectiveness of a transport screw.

Figure 6A:
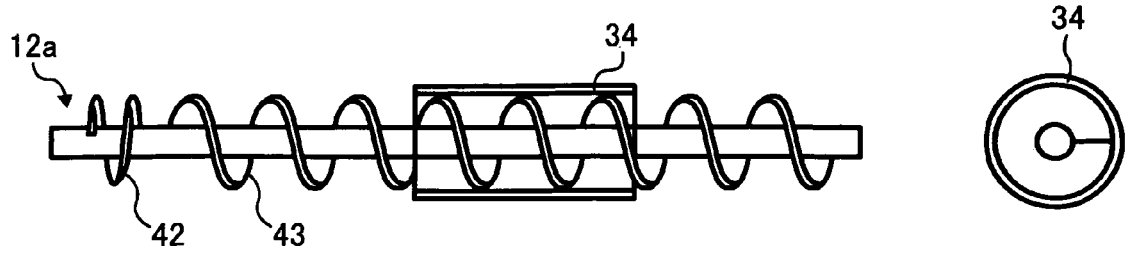
FIGS. 6A, 6B, 6C, and 6D show modified transport screws, which are made by modifying a conventional transport screw to improve agitation effectiveness.

FIG. 6A is a second transport screw 12*a* provided with the tubular member 34 in a similar manner as in FIG. 5.

As shown in FIG. 6A, the second transport screw 12*a* is provided with a spiral member 43 for transporting particles in a forward direction and a spiral member 42 for transporting particles in a reverse direction, and is provided with the tubular member 34, which is attached on the spiral member 43.

Figure 6B:
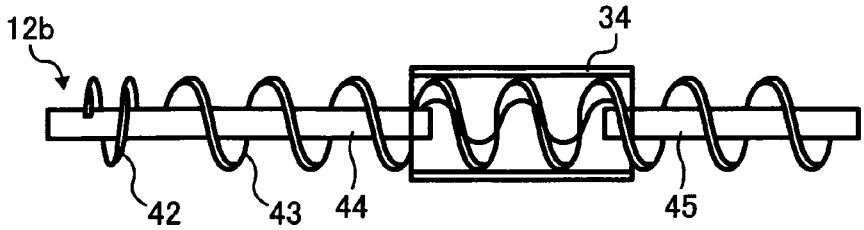

FIG. 6B is a second transport screw 12*b*, which includes separate two shafts: shaft 44 and shaft 45. As shown in FIG. 6B, the tubular member 34 is provided between the shaft 44 and shaft 45, thereby the tubular member 34 is provided at a shaft-free portion. If the shaft is provided in a portion corresponding to the tubular member 34, the shaft may block movement of the developing agent and consequently may lower transport speed of the developing agent. Therefore, the configuration shown in FIG. 6B may prevent a reduction of transport speed of the developing agent.

Figure 6C:
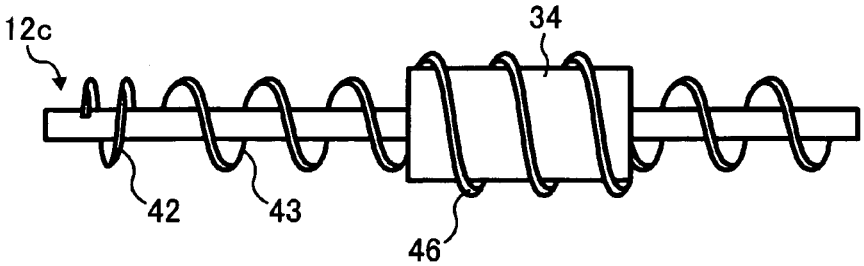

FIG. 6C is a second transport screw 12*c* provided with the tubular member 34, wherein the tubular member 34 is provided with a spiral member 46 on its outer surface.

In case of the second transport screws 12*a* and 12*b* shown in FIGS. 4A and 4B, the developing agent may be split into two portions at the tubular member 34. One portion of the developing agent may be inside the tubular member 34, and another portion of the developing agent may be on the outer surface of the tubular member 34. In such a case, the developing agent on the outer surface of the tubular member 34 may not be transported in a shaft direction of the second transport screws 12*a* and 12*b* because the outer surface of the tubular member 34 is not provided with a transport member.

By proving the spiral member 46 on an outer surface of the tubular member 34 as shown in FIG. 6C, the developing agent may be transported in a relatively smooth manner.

Figure 6D:
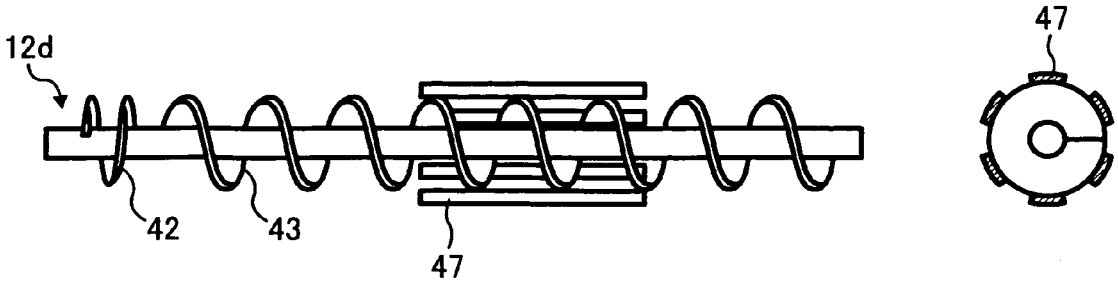

FIG. 6D is a second transport screw 12*d* provided with at least one plate-shaped member 47, which is parallel to the shaft direction of the second transport screw 12*d* instead of the tubular member 34.

A number of plate-shaped member 47 to be provided on the second transport screw 12*d* can be changed, as required, wherein FIG. 6D shows a case that six fin members 47 are provided for the second transport screw 12*d*. Such configuration can also have a similar effect as in other configurations shown in FIGS. 4A to 4C.

The above-described tubular member 34 and the plate-shaped member 47 can be attached to the second transport screw 12 with a non-limiting method such as welding and adhesive method, for example.

Hereinafter, another developing apparatus is explained with reference to FIGS. 7 and 10.

Figure 7:
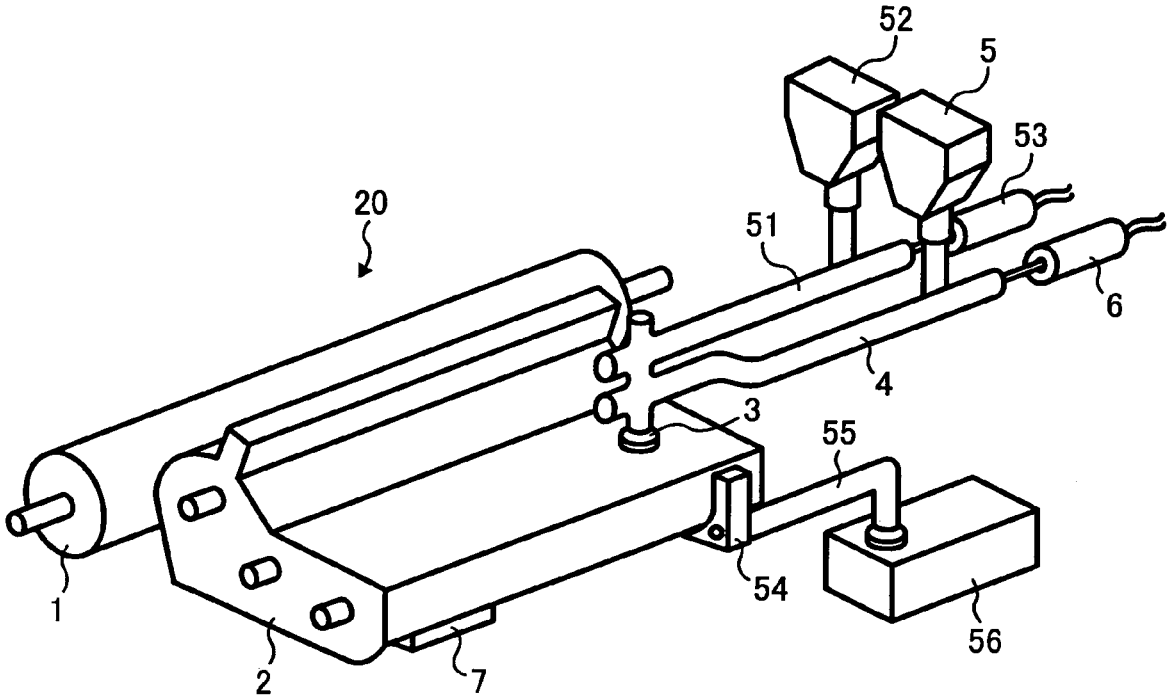
FIG. 7 is a schematic perspective view of another developing apparatus for refilling toner particles and carrier particles according to another example embodiment.

FIG. 7 is a schematic perspective view of a developing apparatus 2 provided with refilling toner particles and carrier particles.

As shown in FIG. 7, the developing apparatus 2 is provided with a carrier transport route 51, a carrier container 52, a motor 53, a developing agent ejection port 54, a developing agent recovery route 55, and a developing agent recovery container 56 in addition to the components shown in FIG. 4.

With such configuration, the carrier particles are refilled in addition to toner particles via the refilling port 3, as required.

Because the carrier particles are not consumed as a number of image forming times increases, in general, an excessive developing agent is ejected from the developing agent ejection port 54 by an overflow of the developing agent as later explained with reference to FIG. 8.

As shown in FIG. 7, the developing agent ejection port 54 can be provided at a position corresponding to an upstream of the refilling port 3.

The overflowed developing agent is transported in the developing agent recovery route 55, and recovered in the developing agent recovery container 56.

The carrier particles may degrade over the time due to reasons such as adhesion of toner particles to the carrier particles and abrasion of coating of the carrier particles, for example. Thereby a replacement of carrier particles may be required with a predetermined timing, wherein the predetermined timing may be determined based on a number of image forming times or a predetermined operating time of an image forming apparatus, for example.

With such method, a predetermined amount of carrier particles can be refilled in the developing apparatus 2 with predetermined timing, as required. Timing for refilling the carrier particles can be controlled by non-limiting methods.

Figure 8:
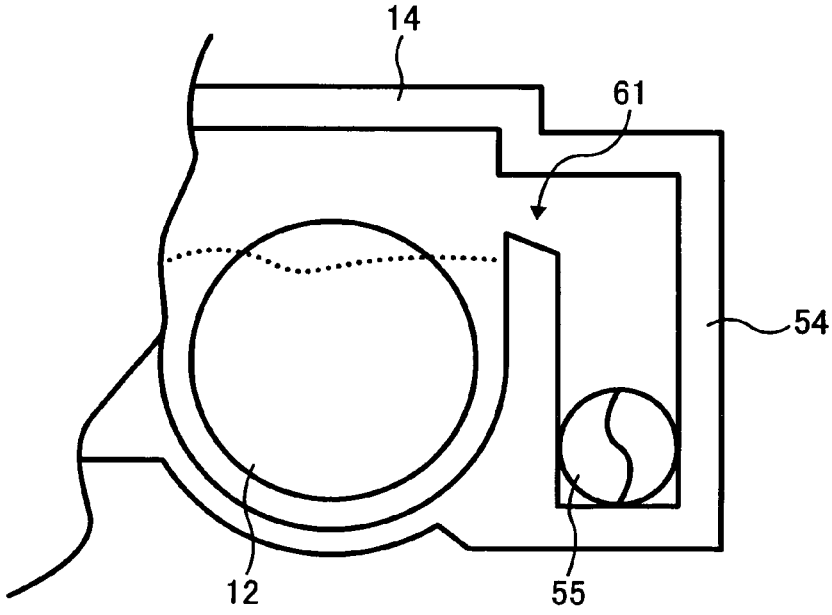
FIG. 8 is a cross-sectional view of a developing agent ejection section of a developing apparatus of FIG. 7.

FIG. 8 is a cross-sectional view of a developing agent ejection section of the developing apparatus 2 of FIG. 7.

Figure 9:
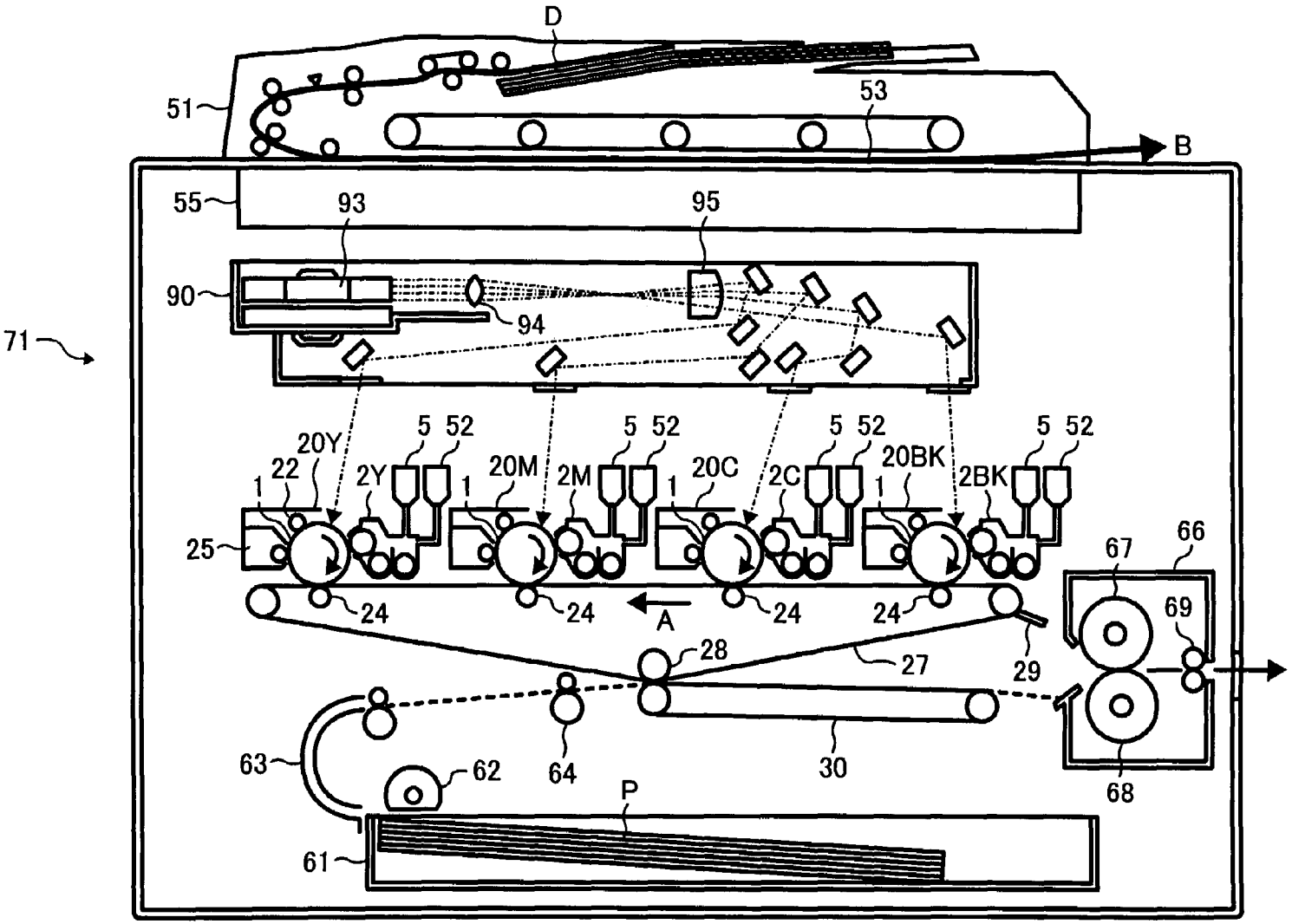
FIG. 9 is a schematic sectional view of an image forming apparatus having a developing apparatus of FIG. 7.

When a height of the developing agent in the developing apparatus 2 increases and exceeds a height of an ejection mouth 61, an excessive developing agent overflows to the developing agent ejection port 54, and is transported to the developing agent recovery container 56 via the developing agent recovery route 55, FIG. 9 shows an image forming apparatus 71 to be equipped with the process cartridge 20 shown in FIG. 7. The image forming apparatus 71 of FIG. 9 is substantially similar to the image forming apparatus 70 of FIG. 1 except that the image forming apparatus 71 includes a configuration for refilling carrier particles shown in FIG. 7 such as carrier container 52.

Figure 10:
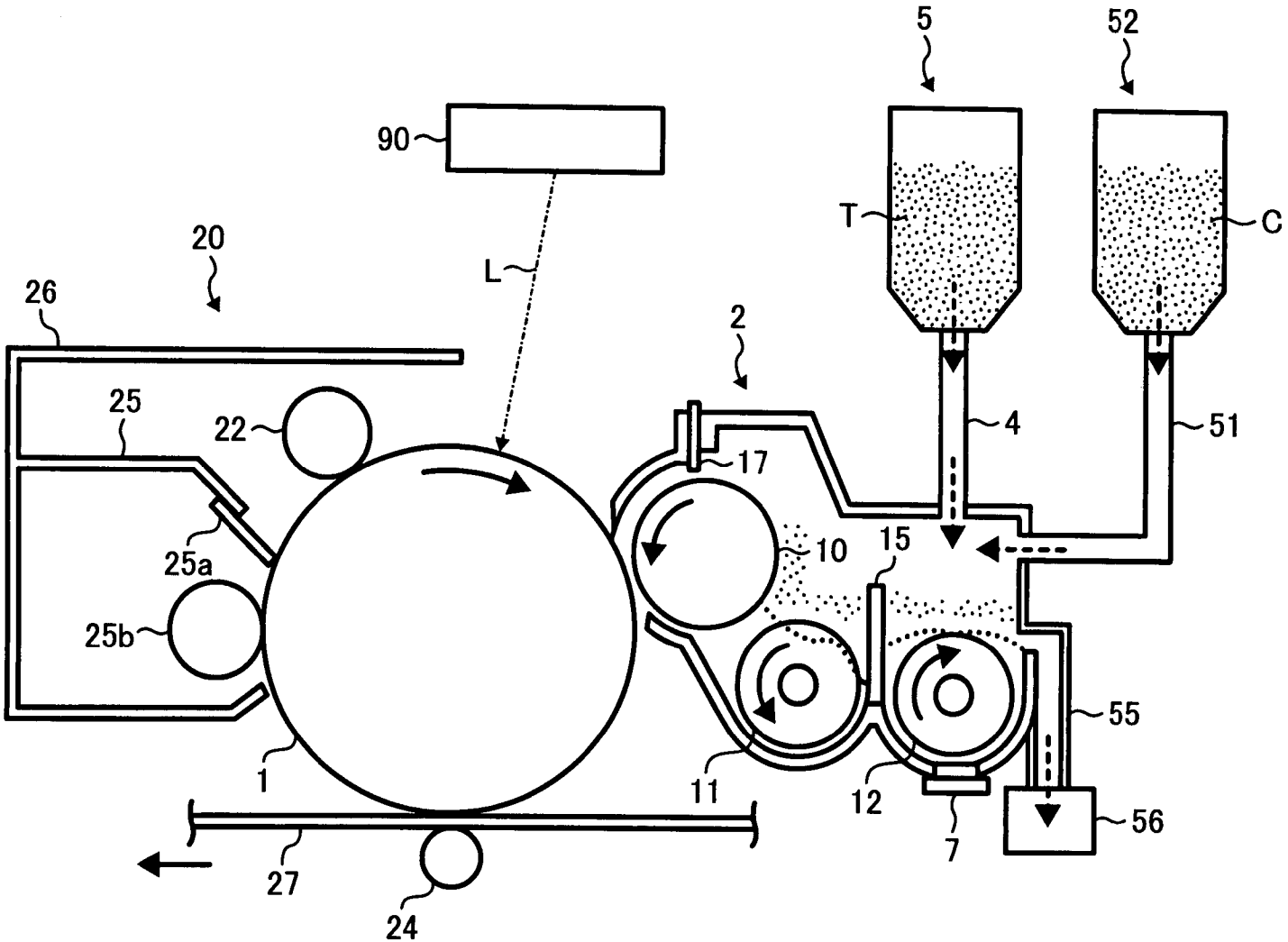
FIG. 10 is a schematic sectional view of a process cartridge for use in an image forming apparatus of FIG. 9.

FIG. 10 shows a schematic cross-sectional view of a configuration including the process cartridge 20 and its surrounding. The configuration shown in FIG. 10 is substantially similar to the configuration shown in FIG. 2 except the developing apparatus is provided with the carrier transport route 51, the carrier container 52, the motor 53, and the developing agent ejection port 54, the developing agent recovery route 55, and the developing agent recovery container 56.

As above-described in the exemplary embodiments, agitation effectiveness of the developing agent can be effectively improved by providing a tubular member on a middle of the transport screw. Such tubular member can improve agitation movement in a radius direction of the transport screw without causing an excessive physical stress to the developing agent.

Numerous additional modifications and variations are possible in light of the above teachings. It is therefore to be understood that within the scope of the appended claims, the disclosure of the present invention may be practiced otherwise than as specifically described herein.

This application claims priority from Japanese patent applications No. 2004-358599 filed on Dec. 10, 2004 in the Japan Patent office, the entire contents of which are hereby incorporated by reference herein.

What is claimed is:

1. A developing apparatus for use in an image forming apparatus, comprising:

a developing roller;

a developing agent including toner particles and carrier particles;

a refilling port, through which the toner particles are refilled in the developing apparatus;

a transport member configured to circulate the developing agent in the developing apparatus;

an agitation enhancer, provided on the transport member, configured to increase an agitation movement of the developing agent; and a toner concentration sensor configured to detect a mix ratio of the toner particles and carrier particles, wherein refilling of the toner particles is controlled based on the mix ratio detected by the toner concentration sensor and wherein the agitation enhancer provided on the transport member is positioned between the refilling port and the toner concentration sensor.

2. The developing apparatus according to claim 1, wherein the transport member includes a transport screw.

3. The developing apparatus according to claim 1, wherein the agitation enhancer is provided on the transport member at a position downstream of the refilling port.

4. The developing apparatus according to claim 1, wherein the agitation enhancer includes tubular member.

5. The developing apparatus according to claim 4, wherein the agitation enhancer has a fin member on an outer periphery thereof configured to transport the developing agent on the outer periphery thereof.

6. The developing apparatus according to claim 4, wherein the transport member include a first shaft and a second shaft, and wherein the agitation enhancer is provided at a shaft-free position between the first shaft and the second shaft.

7. The developing apparatus according to claim 1, wherein the agitation enhancer includes at least one plate-shaped member, which is provided on a peripheral portion of the transport member and arranged in parallel to a shaft direction of the transport member.

8. The developing apparatus according to claim 1, wherein the refilling port is further used to refill the carrier particles in the developing apparatus in addition to the toner particles.

9. The developing apparatus according to claim 8, further comprising an ejection port configured to eject excessive developing agent from the developing apparatus.

10. The developing apparatus according to claim 9, wherein the ejection port is provided at a position upstream of the refilling port.

11. The developing apparatus according to claim 1, wherein the transport member includes a first transporter configured to supply the toner particles to the developing roller, and a second transporter configured to transport the developing agent to the first transporter, and wherein the agitation enhancer is provided on the second transporter.

12. The developing apparatus according to claim 1, wherein the agitation enhancer is provided on a periphery of the transport member.

13. A process cartridge for use in an image forming apparatus, comprising:

a photosensitive member configured to form an electrostatic latent image; and a developing apparatus configured to develop the electrostatic latent image, comprising:

a developing roller;

a developing agent including toner particles and carrier particles;

a refilling port, through which the toner particles are refilled in the developing apparatus;

a transport member configured to circulate the developing agent in the developing apparatus;

an agitation enhancer, provided on the transport member, configured to increase agitation movement of the developing agent; and a toner concentration sensor configured to detect a mix ratio of the toner particles and carrier particles, wherein refilling of the toner particles is controlled based on the mix ratio detected by the toner concentration sensor and wherein the agitation enhancer provided on the transport member is positioned between the refilling port and the toner concentration sensor.

14. The process cartridge according to claim 13, further comprising a charging unit configured to charge the photosensitive member and a cleaning unit configured to clean the photosensitive member.

15. The process cartridge according to claim 13, wherein the transport member includes a transport screw.

16. The process cartridge according to claim 13, wherein the agitation enhancer is provided on the transport member at a position downstream of the refilling port.

17. The process cartridge according to claim 13, wherein the transport member includes a first transporter configured to supply the toner particles to the developing roller, and a second transporter configured to transport the developing agent to the first transporter, and wherein the agitation enhancer is provided on the second transporter.

18. The process cartridge according to claim 13, wherein the agitation enhancer is provided on a periphery of the transport member.

19. An image forming apparatus, comprising:

a process cartridge, comprising:

a photosensitive member configured to form an electrostatic latent image; and a developing apparatus configured to develop the electrostatic latent image, comprising:

a developing roller;

a developing agent including toner particles and carrier particles;

a refilling port, through which the toner particles are refilled in the developing apparatus;

a transport member configured to circulate the developing agent in the developing apparatus;

an agitation enhancer, provided on the transport member, configured to increase agitation movement of the developing agent; and a toner concentration sensor configured to detect a mix ratio of the toner particles and carrier particles, wherein refilling of the toner particles is controlled based on the mix ratio detected by the toner concentration sensor and wherein the agitation enhancer provided on the transport member is positioned between the refilling port and the toner concentration sensor.

20. The image forming apparatus according to claim 19, wherein the process cartridge further comprises a charging unit configured to charge the photosensitive member and a cleaning unit configured to clean the photosensitive member.

21. The image forming apparatus according to claim 19, wherein the transport member includes a transport screw.

22. The image forming apparatus according to claim 19, wherein the agitation enhancer is provided on the transport member at a position downstream of the refilling port.

23. The image forming apparatus according to claim 19, wherein the transport member includes a first transporter configured to supply the toner particles to the developing roller, and a second transporter configured to transport the developing agent to the first transporter, and wherein the agitation enhancer is provided on the second transporter.

24. The image forming apparatus according to claim 19, wherein the agitation enhancer is provided on a periphery of the transport member.

* * * * *